US005474810A

United States Patent [19]

Yen

[11] Patent Number: 5,474,810

[45] Date of Patent: Dec. 12, 1995

[54] PROCESS FOR PRODUCING PU SUEDE-TYPE SYNTHETIC LEATHER

[75] Inventor: Wang M. Yen, Chang-Hua Hsien, Taiwan

[73] Assignee: Hofa Trading Co., Ltd., Taipei, Taiwan

[21] Appl. No.: 268,169

[22] Filed: Jun. 29, 1994

[51] Int. Cl.[6] ..... B05D 3/12

[52] U.S. Cl. ..... 427/289; 83/15; 83/870; 427/244; 427/245; 427/316; 427/370; 427/374.2; 427/374.3; 427/379; 427/393.5

[58] Field of Search ..... 427/244, 245, 427/246, 289, 316, 370, 374.2, 374.3, 389.9, 379, 393.5; 83/13–15, 870

[56] References Cited

U.S. PATENT DOCUMENTS 3,776,753 12/1973 Habib ..... 427/289
3,861,937 1/1975 Hanneken et al. ..... 427/276 X
3,912,840 10/1975 Edberg ..... 427/205 X
4,216,251 8/1980 Nishimura et al. ..... 427/370

*Primary Examiner*—Michael Lusignan
*Attorney, Agent, or Firm*—Alfred Lei

[57] ABSTRACT

A process for producing continuous polyurethane suede-type synthetic leather including steps of applying dipping treatment to a fabric with a thickness of 0.2–2.0 mm, pressing the fabric with pressing rollers at a pressure of 0–50 kg, ironing the fabric with ironing wheels at a temperature of 50–150 C./wheel, covering the fabric with a layer of wet coating so that the fabric together with the coating has a thickness of 1.0–2.0 mm, cooling the fabric by a 0–50% DMF solution at a water temperature of 5–40 C., cleansing the fabric at a temperature of 30–100 C., pressing the fabric at a pressure of 0–5 kg, preheating the fabric with one to fifteen preheating wheels at a temperature of 50–200 C., drying the fabric at a temperature of 50–200 C. to obtain a semi-product, and slicing the semi-product into a first sheet of upper polyurethane suede-like synthetic leather and a second sheet of lower polyurethane suede-like synthetic leather with fabric.

2 Claims, 2 Drawing Sheets

PROCESS FOR PRODUCING PU SUEDE-TYPE SYNTHETIC LEATHER

BACKGROUND OF THE INVENTION

The conventional process for producing PU suede-type synthetic leather includes steps of applying a fabric with a layer of PU coating, cooling the fabric, cleansing the fabric, drying the fabric to a semi-product, and grinding the semi-product for one to three times to form a suede-type synthetic leather. However, according to this process, the surface of the semi-product will be grounded off by a thickness of 0.05–0.15 mm thereby producing a lot of powder and therefore polluting the air and hurting the operator's health.

In addition, the surface of the semi-product is grounded off thus wasting the material and increasing the cost.

Furthermore, the conventional process for producing PU suede-type synthetic leather has the following drawbacks:

1. A lot of powder will be produced during the process thereby polluting the air and therefore hurting the operator's health.
2. It is necessary to grind off the surface of the product thus increasing the cost.
3. The surface and the interior of the product do not condense at the same rate.
4. The product does not have vertical pores.
5. The wet semi-product is liable to be hurt by water and air.
6. Only one kind of PU suede-type synthetic leather is obtained.

Therefore, it is an object of the present invention to provide a process for producing continuous PU suede-type synthetic leather which can obviate and mitigate the above-mentioned drawbacks.

SUMMARY OF THE INVENTION

This invention relates to a process for producing continuous PU suede-type synthetic leather.

It is the primary object of the present invention to provide a process for producing continuous PU suede-type synthetic leather by means of which a sheet of upper slice and a sheet of lower slice can be obtained.

It is another object of the present invention to provide a process for producing continuous PU suede-type synthetic leather which is no longer necessary to be grounded thereby decreasing material cost.

It is still another object of the present invention to provide a process for producing continuous PU suede-type synthetic leather which will not produce powder thus preventing the air from being polluted.

It is still another object of the present invention to provide a process for producing continuous PU suede-type synthetic leather which has vertical pores.

It is a further object of the present invention to provide a process for producing continuous PU suede-type synthetic leather which does not have defects produced by water or air.

The other objects and merits and a fuller understanding of the present invention will be obtained by those having ordinary skill in the art when the following detailed description is read in conjunction with the accompanying drawings wherein like numerals refer to like or similar part.

DETAILED DESCRIPTION OF THE PREFERRED EMBODIMENT

Figure 1A:
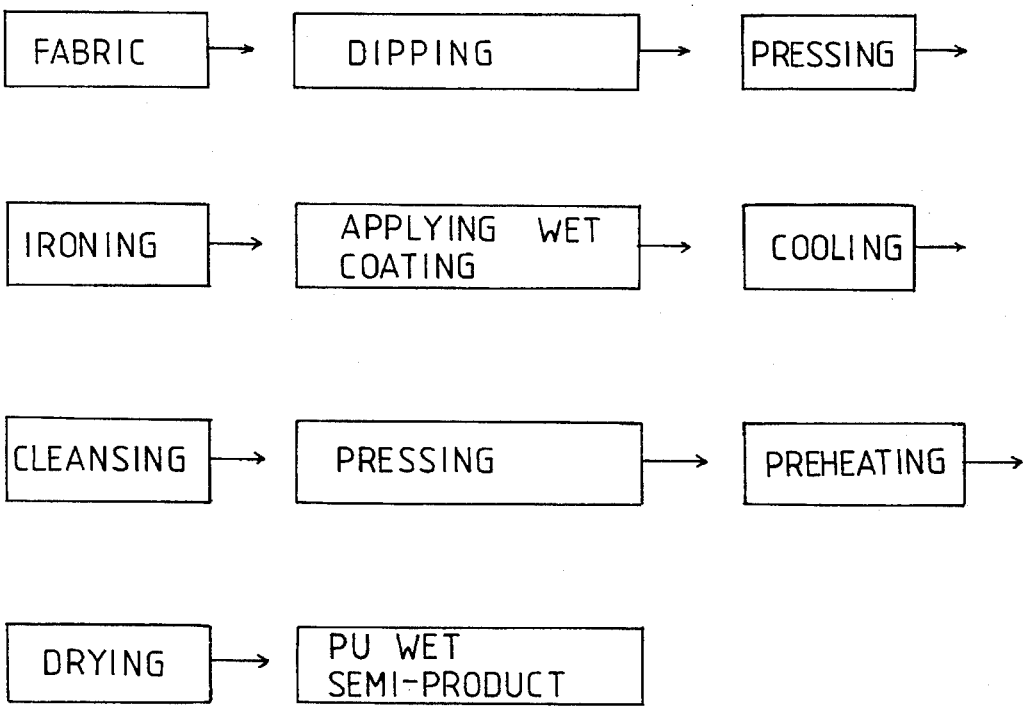
FIG. 1A is a block diagram showing the first part of the process for producing continuous PU suede-type synthetic leather according to the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

The process for producing continuous PU suede-type synthetic leather according to the present invention mainly comprises two parts. The first and second parts are shown in FIGS. 1A and 1B respectively.

Figure 1B:
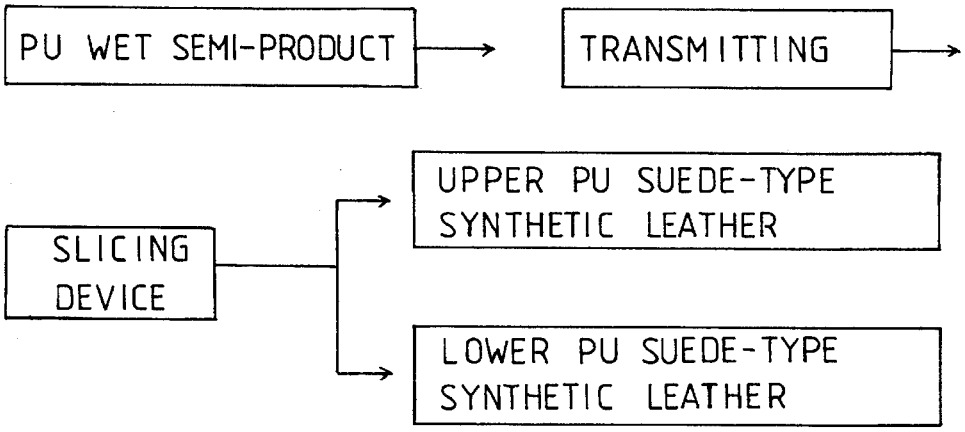
FIG. 1B is a block diagram showing the second part of the process for producing continuous PU suede-type synthetic leather according to the present invention.
Figure 2:
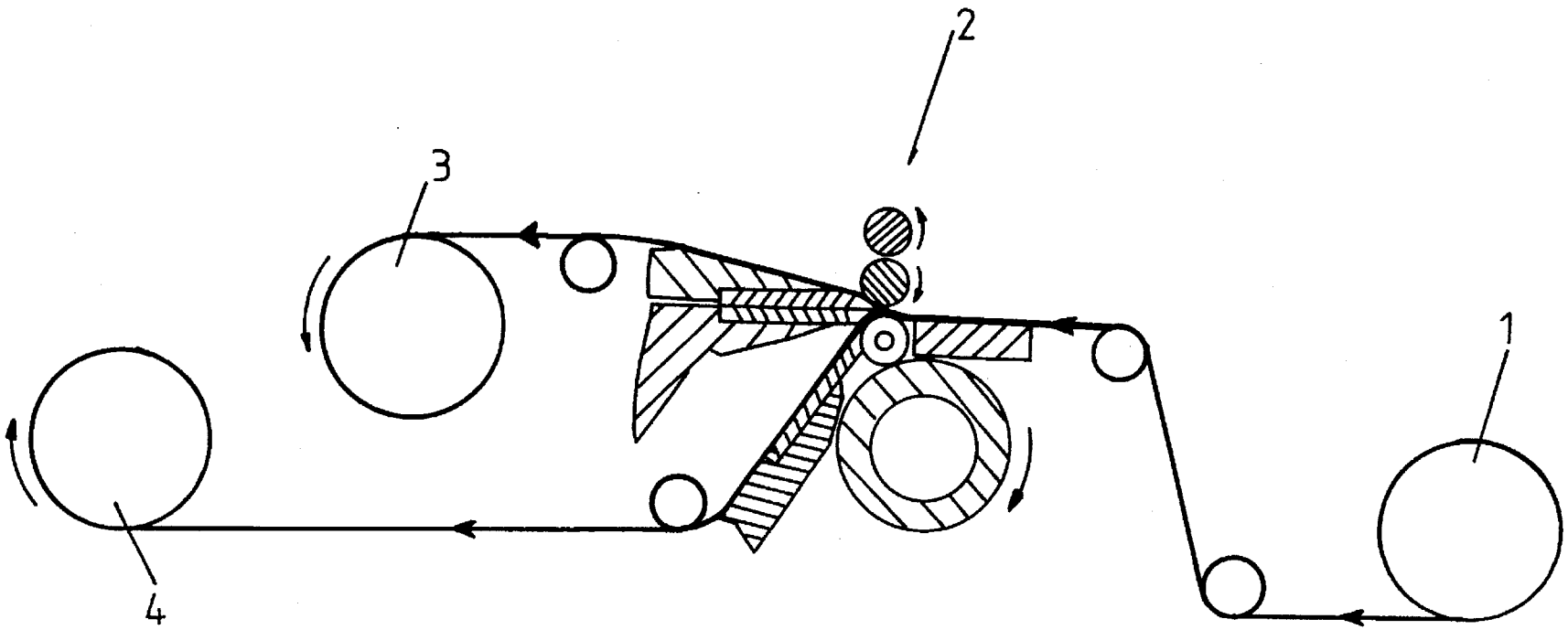
FIG. 2 shows a slicing device according to the present invention.

As illustrated in FIG. 1A, the first part of the process for producing continuous polyurethane suede-like synthetic leather comprises step of applying dipping treatment to a fabric with a thickness of 0.2–2.0 mm, pressing the fabric with rollers at a pressure of 0–5 kg, ironing the fabric with one to ten ironing wheels at a temperature of 50–150 C., covering the fabric with a special wet coating so that the fabric together with the coating has a thickness of 1.0–2.0 mm, cooling the fabric with a 0–50% dimethyl formamide solution at a water temperature of 5–40 C., cleansing the fabric at a temperature of 30–100 C., pressing the fabric by rollers at 0–50 kg, preheating the fabric with 1–15 preheating wheels at a temperature of 50–200 C./per wheel, and drying the fabric at a temperature of 50–200 C.

The composition of the special wet coating is as follows:

| CONSTITUENT | PROPORTION |
|---|---|
| liquid wet resin | 90–110 |
| dimethyl formamide | 50–120 |
| water | 3–15 |
| negative ion interface activating agent | 1–5 |
| non-ion interface activating agent | 1–5 |
| filler | 1–20 |
| dye | 1–20 |

Then, the semi-product is transmitted by the base material 1 to a slicing device 2 and sliced into a first sheet of upper PU suede-type synthetic leather 3 and a second sheet of lower PU suede-type synthetic leather 4.

The first sheet of upper PU suede-type synthetic leather 3 can be directly used for covering a note book, a purse, or the like and can be also adhered to non-fabric cloth or the like to form a material for sports shoes. Moreover, the upper PU suede-type synthetic leather 3 can be stuck woven cloth to provide material for clothes.

The second sheet of lower PU suede-type synthetic leather 4 is provided with fabric and can be conveniently used as material for shoes.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A process for producing continuous polyurethane synthetic leather comprising steps of:

applying dipping treatment to a fabric with a thickness of 0.2–2.0 mm;

pressing said fabric with pressing rollers at a pressure of 0–50 kg;

ironing said fabric with ironing wheels at a temperature of 50–150 C./wheel;

covering said fabric with a layer of wet coating so that said fabric together with the coating has a thickness of 1.0–2.0 mm;

cooling said fabric by a 0–50% dimethyl formamide solution at a water temperature of 5–40 C.;

cleansing said fabric at a temperature of 30–100 C.;

pressing said fabric at a pressure of 0–5 kg;

preheating said fabric by one to fifteen preheating wheels at a temperature of 50–200 C.;

drying said fabric at a temperature of 50–200 C. to obtain a semi-product; and slicing said semi-product into a first sheet of upper polyurethane synthetic leather and a second sheet of lower polyurethane synthetic leather with fabric.

2. The process for producing continuous polyurethane synthetic leather as claimed in claim 1, wherein said wet coating has a thickness of more than 0.7 mm after dried and is composed of a liquid wet polyurethane resin, dimethyl formamide, water, negative ion interface activating agent, non-ion interface activating agent, filler, and dye which are in proportion of (90–110): (50–120):(3–15):(1–5): (1–5):(1–20): (1–20).

* * * * *